United States Patent [19]

Burton et al.

[11] 4,182,277

[45] Jan. 8, 1980

[54] STEAM SEPARATOR TO REDUCE CARRYUNDER

[75] Inventors: Charles L. Burton, Vernon; Bard C. Teigen, Enfield, both of Conn.

[73] Assignee: Combustion Engineering, Inc., Windsor, Conn.

[21] Appl. No.: 908,432

[22] Filed: May 22, 1978

[51] Int. Cl.[2] ..... F22B 37/26; B01D 45/12

[52] U.S. Cl. ..... 122/491; 55/346; 55/457

[58] Field of Search ..... 122/488, 491; 55/346, 55/396, 397, 398, 457, 452

[56] References Cited

U.S. PATENT DOCUMENTS

| | | | |
|---|---|---|---|
| 3,086,343 | 4/1963 | Stern | 55/346 |
| 3,089,469 | 5/1963 | Mumford | 122/491 |
| 3,603,062 | 9/1971 | Robbins et al. | 55/457 |

*Primary Examiner*—Kenneth W. Sprague

*Attorney, Agent, or Firm*—Joseph H. Born; William W. Habelt

[57] ABSTRACT

A bubble rake for removing the remaining steam from liquid water that is returning to heat-exchange surfaces after an initial separation from steam. The bubble rake is a channel-forming member having a cross section generally in the shape of an upside-down U. The bubble rake is disposed in a fluid-flow path so that the channel opens down and in the direction of the path. A stall zone formed by a rake traps steam in the channel, and the channel is positioned longitudinally at an angle with the horizontal so that the trapped steam migrates to its high end, where an opening allows the trapped steam to join the steam previously separated from the water.

3 Claims, 4 Drawing Figures

STEAM SEPARATOR TO REDUCE CARRYUNDER

BACKGROUND OF THE INVENTION

Steam generators are used both in fossil-fuel and nuclear power plants to generate working steam for driving turbines. Water is fed to heat-exchange surfaces connected directly or indirectly to the nuclear-reactor core in the case of a nuclear system; in the case of a fossil-fuel system, the surfaces are located in the furnace. A steam-water mixture is thus produced, and this mixture is sent to a separator that returns the water to the heat-exchange surfaces and sends the steam ultimately to the turbine. Since the design of both nuclear and fossil units are made with certain assumptions concerning the thermal energy present in the coolant being fed to the heat-exchange surfaces, it is desirable that the amount of steam "carried under" with the separated water be controlled. In general, the amount of steam carried under should be minimized.

SUMMARY OF THE INVENTION

The present invention is accordingly a means for reducing carryunder, the amount of steam that accompanies the water returning to the heat-exchange surfaces in a steam generator. It is intended to be used in a steam generator that comprises means for separating steam from water, means for transferring heat to water to create a steam-water mixture, means for delivering the mixture to the separation means, and means for returning the separated water along a flow path from the separating means back to the heat-transfer means. The return means in such a steam generator includes a plenum for collecting water separated by the separation means so that water occupies the plenum up to a water level and steam occupies the plenum above the water level.

According to the present invention there is disposed in the flow path a bubble rake having a surface facing generally down and in the direction of the flow path and defining a generally downward-opening channel extending longitudinally at an angle with the horizontal. The channel thereby has a high end, and the buoyancy of any steam entering the channel causes it to be trapped in the channel and to migrate to the high end. The channel, according to the present invention, forms an opening at its high end for releasing the trapped steam. The steam is thereby released in a more concentrated state and at a higher level, and this reduces the entrainment of steam by the water.

BRIEF DESCRIPTION OF THE DRAWINGS

These and further features and advantages of the invention are described in connection with the attached drawings, in which.

DETAILED DESCRIPTION OF THE PREFERRED EMBODIMENT

Figure 1:
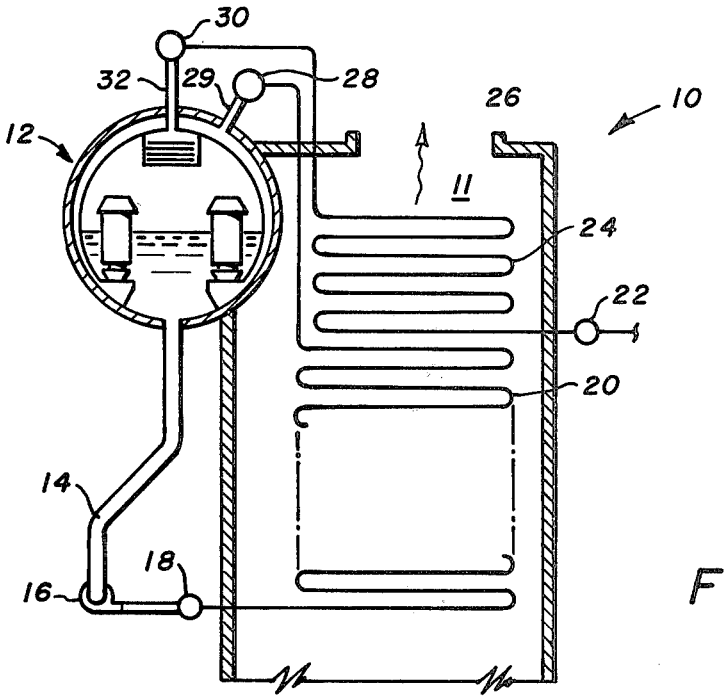
FIG. 1 is a highly simplified diagrammatic view of a typical fossil-fuel steam generator.

FIG. 1 shows in a highly simplified manner the arrangement of a fossil-fuel steam generator. The steam generator 10 includes a furnace 11 in which heat-exchange surfaces, tubes 20 and 24, are disposed. Fuel is burned in furnace 11, heating up tubes 20 and 24 and the fluid inside them. Means not shown supply feedwater to the interior of a steam drum 12, and pump 16 forces this feedwater through conduit 14 to tubes 20. As has been pointed out, this is a highly simplified rendering, and there would normally be a plurality of tubes 20 covering the entire furnace wall. Accordingly, at least one appropriate header 18 is provided for distribution of the water from drum 12 to various tubes 20. Header 18 typically contains only water, but during transit through tubes 20 this water absorbs enough thermal energy to produce a certain amount of steam. Accordingly, by the time the fluid reaches header 28, a portion of it is steam. Steam separators in the steam drum remove the water from the steam, and the removed steam is sent out of the drum through conduit 32. This steam is then distributed by header 30 to various superheater tubes 24, which absorb further thermal energy to raise the steam temperature above saturation. The superheated steam is collected by header 22 and supplied to the turbine.

The water separated from the steam by the separators in drum 12 is returned, along with fresh feedwater, to the furnace through the route previously described.

Figure 2:
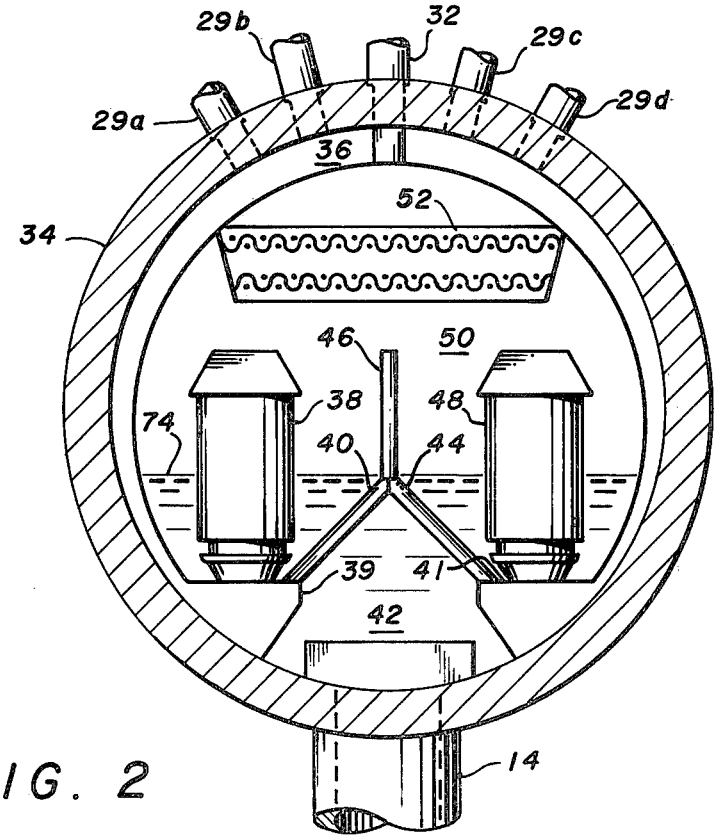
FIG. 2 is a cross-sectional view of steam drum 12 of FIG. 1.

The steam drum is shown in further detail in FIG. 2. FIG. 2 is a cross-sectional view of the steam drum, which is a generally cylindrical drum containing two rows of separators 38 and 48. Drum 34 is penetrated by pipes 29*a* through 29*d*, which receive the steam-water mixture from the furnace. A generally annular space 36 is provided about the interior of the drum to lead the mixture to the separators 38 and 48. Interior to the drum and radially inward from annular space 36 is a water space 42, which defines a water level 74 and a steam space 50. In order to enter the plenum composed of steam space 50 and water space 42, the mixture must pass through one of the separators in row 38 or 48, and the water in the mixture is accordingly separated from the steam. The water separated out by the separators returns to the furnace through conduit 14, whereas steam in steam space 50 is passed through dryer 52 in order to remove the remaining water. The steam is then sent to the superheater through tubes 32. (It is to be understood that a row of tubes 32 is disposed behind the one shown, just as rows of separators are disposed behind the two shown).

According to the present invention, bubble rakes 40 and 44, to be described in more detail later, are arranged in the flow path taken by water leaving the separator and returning to the furnace through conduit 14. The steam removed by rakes 40 and 44 is conducted to steam space 50 by appropriate tube 46, a means for conducting steam to the part of the plenum above water line 74. As will be described in more detail below, bubble rakes may also be included in separator 38 and 48.

Figure 3:
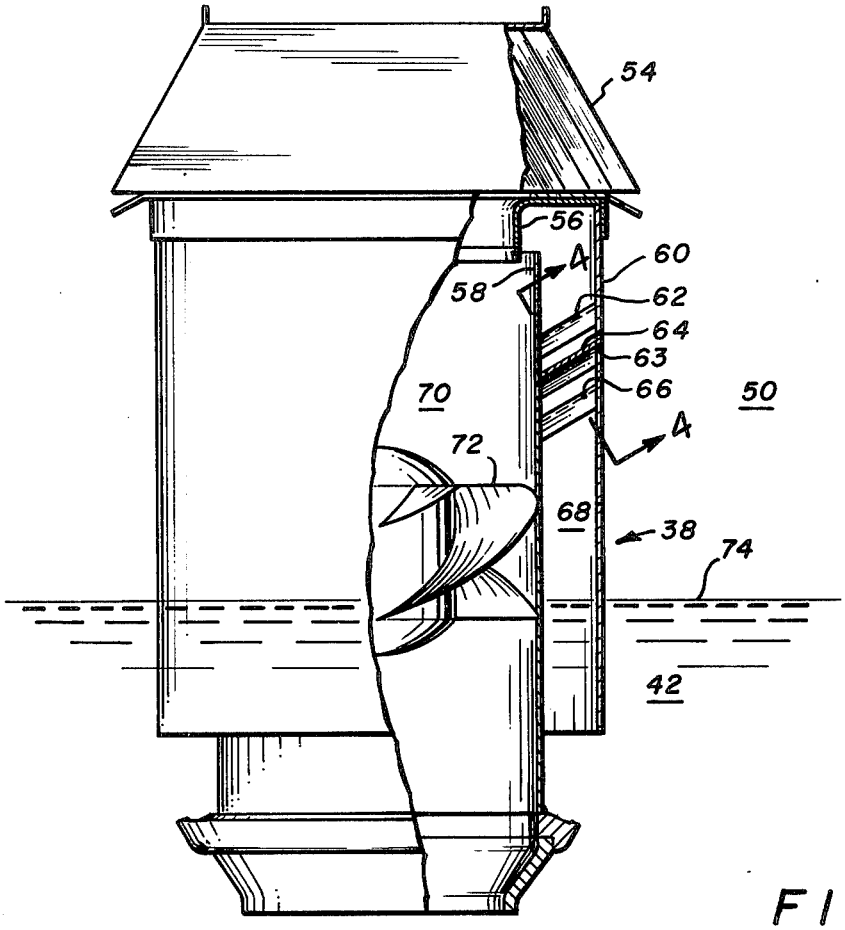
FIG. 3 is a view, partly in section, of separator 38 of FIG. 2.

FIG. 3 is a cross-sectional view of one of the separators shown in FIG. 2. The separator is of the centrifugal variety and comprises a can 58 that defines the separation zone 70 inside which a stationary blade assembly 72 is mounted. Can 58 is mounted so as to receive the steam-water mixture at its lower end and direct it past blade assembly 72. A lip 56 is mounted at the top of can 58 in order to skim off the liquid forced outward to the interior surface of the can by the centrifugal action of the separator. A jacket 60 is mounted around can 58 and, together with can 58, defines an annular downcomer space 68 through which water skimmed by lip 56 is directed. A secondary separator, consisting of corrugated plates, is mounted above can 58 for further removal of water from the steam that leaves can 58 at its upper end. Unlike can 58 and jacket 60, the corrugated plates of secondary separator 54 are not circular in cross-section; the water separated by the plates cascades down to the right and left but does not issue from the front (out of the page) or the back (into the page) of the separator.

When the steam generator is operating, the steam-water mixture enters steam drum 34 (FIG. 2) by way of pipes 29 and is conducted through annular space 36 to separation space 70 (FIG. 3) of separator 38. The fluid flows at a relatively high velocity, and blade assembly 72 imparts a circular motion to the fluid. The water droplets in the fluid, being denser than the steam, tend to describe larger circles, and the liquid phase accordingly predominates at the outer edge of separation space 70 when the fluid reaches the upper end of the can 58. That part of the mixture that is skimmed by lip 56 is predominantly water, therefore, while the part of the mixture that reaches secondary separator 54 has a higher concentration of steam. The skimmed-off fluid is directed by means of annular downcomer 68 to water space 42, where it follows the ordinary flow path of the water from space 42 to conduit 14 (FIG. 2). The part of the mixture that passes through secondary separator 54 (FIG. 3) contacts the corrugated plates therein, and much of the remaining liquid contents deposits on the corrugated plates and cascades down to water space 42 through the part of steam space 50 exterior to jacket 60. This water also follows the normal flow path back to the furnace. Most of the steam portion of the mixture flowing through secondary separator 54 is released to steam space 50, from which it passes through dryer 52 (FIG. 2) and follows pipe 32, ultimately reaching the superheater. In summary, can 58, together with blade assembly 72 and lip 56, constitutes a means for separating water from steam. The plenum consisting of steam space 50 and water space 42, together with annular downcomer 68, is part of a means for returning the separated water from the separation means to the heat-transfer means. Thus, water keeps traversing the system until it becomes steam.

As may be suspected, the separation is not perfect; some steam remains in the water that is skimmed off into the annular downcomer 68, and there is also steam that is entrained by water cascading from secondary separator 54 into water space 42. The amount of steam carried into water space 42 is referred to as carryunder, which it is the purpose of the present invention to reduce. According to the present invention, the amount of steam that is carried into water space 42 through downcomer 68 is reduced by means of bubble rakes 62, 64, and 66 and corresponding rakes positioned around the circumference of annular downcomer 68. Bubble rakes 62, 64, and 66 are shown in cross section in FIG. 4, a section taken through line 4—4 of FIG. 3. Each rake extends longitudinally from can 58 to jacket 60 and is inclined upward in the direction of jacket 60. The rakes have cross-sections in the shape of inverted U's, forming channels that open downward, generally facing the direction in which the liquid water flows. At the upper ends of channels 76 and 78, jacket 60 is penetrated by openings such as opening 63 in order to allow the channels to open to the exterior of the separator.

It has been found that when water flows past discontinuities in obstructions such as the rakes, a stall zone is formed immediately downstream of them, and the stall zone is typically filled by steam. If the rakes form channels as shown in order to trap the steam by its buoyancy, then the rakes can be employed to remove the steam. Since the rakes are inclined at an angle with the horizontal, the steam trapped in the channels will tend to migrate to the high ends of the channels, and the openings formed in the jacket will release the steam to the steam space.

Water level 74 is shown in FIG. 3 as being below the level of the rakes. As a practical matter, the water level in a steam drum is subject to wide variations, and it may not be found desirable or practical to locate the upper ends of the channels above the highest level that the water space may reach. Though a lower location of the rakes may contribute to a certain amount of carryunder, it is thought that the overall effect of the rakes will still be carryunder reduction. This is because the upper ends of the rakes can be expected to be above the water line at least some of the time, and even when they are not, the steam at the outlet of the rakes will tend to be somewhat concentrated, reducing the amount of surface area per pound of steam and thus the amount of entrainment. In other words, steam in small bubbles is concentrated by the rakes into large bubbles, facilitating its release to steam space 50.

Bubble rakes can also be used in the positions shown in FIG. 2. Unlike the rakes illustrated in FIG. 3, those shown in FIG. 2 reduce the carryunder caused both by the steam entering through downcomer 68 and that cascading from secondary separator 54. Such rakes can therefore be used whether or not rakes in the annular downcomer region of the separator are also used. Rakes 40 and 44 of FIG. 2 has a cross section similar to that of rakes 62. (Of course, it is not absolutely necessary that the cross-section be U-shaped. A V-shaped cross-section, or any cross-section that forms a downward-opening channel, is appropriate for use in the present invention.) Rakes 40 and 44, as well as a plurality of rakes distributed behind them along the length of drum 34, are mounted on ledges 39 and 41 formed by annular space 36. They are disposed in the flow path of the water leaving separators 38 and 48 and flowing to conduit 14, and they perform the same functions as rakes 62, 64, and 66 of FIG. 3. However, the steam that migrates to the upper ends of rakes 40 and 44 is lead into steam space 50 by tube 46, and it is practical to locate the upper end of tube 46 so that it is always above water level 74. (Actually, it would be possible to achieve this effect in the other arrangement by adding a second jacket exterior to and concentric with jacket 60 that would be closed at the bottom so as to prevent water from entering. This would correspond in function to tube 46. However, this would require an extra fitting on each of the separators, which in many cases would be impractical.)

It is to be expected that the combination of both types of rakes would improve the reduction of carryunder over that afforded by either method used by itself. If one or the other is to be used alone, however, it is suggested that rakes such as 40 and 44 be used, not only because they affect the carryunder caused by cascading from secondary separator 54, but also because their design tends to be simpler. The reason for this simplicity has to do with the fact that the rate of fluid flow past the rakes as compared to their spacing has an effect on their operation. If the rakes are spaced too widely, the probability is too great that steam in a given volume element of the fluid will be too far from the discontinuity at the edge of a rake to be drawn into a stall zone. On the other hand, if the rakes are spaced so close together that the fluid velocity in the spaces between them is too great, the pressure drop caused by the flow velocity will lower the pressure in the channel below that of the steam space that the channel feeds. This would result in fluid being drawn into the channel instead of being allowed to flow out.

Since the fluid-flow rate will normally not be designed around the presence of the rakes, the spacing of the rakes between each other as compared to their size must be optimized to afford a trade-off between pressure drop and the number of rakes desired for effective steam removal. This trade-off is a consideration in both types of rakes, but it tends to be less difficult to take into account in the type of rake exemplified by rakes 40 and 44. The fluid-flow rate depends to some extent on the water level, which is non-uniform as well as non-constant, so the fluid-flow rate in some of the separators 38 and 48 may be high, causing steam to be drawn from the steam space and re-entrained in the water, even though the average flow rate is low. In addition, the water levels on different sides of the same separator may be different. With rakes 40 and 44, however, there will be a tendency for the rakes to redistribute the water, reducing the non-uniformity and the possibility of re-entrainment. Thus, the range of fluid-flow rates for which rakes 40 and 44 must be designed can be expected to be narrower than that to which rakes 62, 64, and 66 must be designed.

Figure 4:
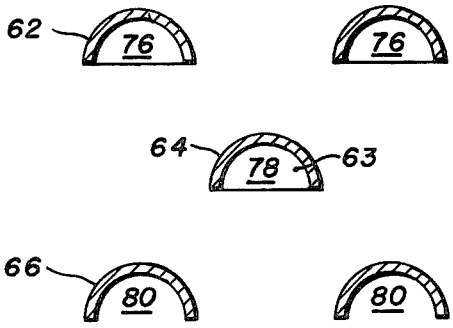
FIG. 4 is a somewhat diagrammatic representation of the rakes as seen at line 4—4 of FIG. 3.

In further regard to re-entrainment, it is to be noted that the rakes in FIG. 4 are staggered and that the lowest row has no openings at the ends of the channels. The staggered arrangement is thought to reduce to an extent the pressure drop that results from the increased flow rate caused by the rakes, the reduced pressure drop will reduce the likelihood that steam will be drawn back in by the low pressure caused by the fluid flow. The absence of openings on the lowest row indicates that it might be desirable that these rakes be "blanks". Since there are no further rakes downstream of the lowest row to reduce the flow-induced pressure drop, the channels may be closed, or the openings on their upper ends eliminated, in order to prevent them from drawing steam in from the exterior of the separator.

While the invention has been described in connection with preferred embodiments, it is to be understood that many modifications and variations will be apparent in light of the foregoing disclosure. It is intended to include all such modifications and variations as fall within the scope of the appended claims.

What is claimed is:

1. In a steam generator comprising a steam drum enclosing a plenum, means disposed within the plenum of the steam drum for separating steam from liquid water, the plenum for collecting liquid water and steam separated by the separation means, the liquid water thereby forming a water level in the plenum above which the separated steam occupies the plenum during operation of the steam generator, means for transferring heat to water to create a mixture of steam and water, means for delivering the mixture to the separation means, and means for returning the separated liquid water along a flow path from the separation means back to the heat-transfer means, the return means having an inlet opening into the plenum at a location below the water level therein, the improvement comprising: a bubble rake disposed within the plenum external to the separation means at a location in the flow path below the water level and near the inlet of the return means, the bubble rake having a surface that defines a channel opening generally down and in the direction of the flow path and extending longitudinally at an angle with the horizontal, the channel thereby having a high end, the buoyancy of steam entering the channel thereby causing it to be trapped in the channel and migrate to the high end of the channel, the channel forming an opening at its high end for releasing the trapped steam, whereby steam remaining in the separated water is removed therefrom and released at a higher level, the amount of steam returned to the heat-transfer means thereby being reduced.

2. An apparatus as recited in claim 1, wherein the bubble rake, further comprises means for conducting the steam from the high end of the channel to the part of the plenum above the water level.

3. An apparatus as recited in claim 1, wherein the separation means comprises a centrifugal separator that is disposed in the plenum and includes a separator can, which can defines a centrifugal separation zone for separating water from steam, the can being surrounded by a jacket, shaped to form a downcomer between the jacket and the can, that feeds the plenum, the separator further comprising a lip for directing the separated water into the downcomer, wherein the flow path includes the downcomer, and wherein the bubble rake is disposed in the downcomer, its upper end meeting the downcomer jacket, the jacket forming an opening at the upper end of the bubble rake for permitting steam trapped in the channel to pass to the exterior of the jacket.

* * * * *